US009756423B2

(12) United States Patent
Simons

(10) Patent No.: US 9,756,423 B2
(45) Date of Patent: Sep. 5, 2017

(54) METHOD FOR REMOVING ELECTRIC CROSSTALK

(71) Applicant: Océ-Technologies B.V., Venlo (NL)

(72) Inventor: Jan Simons, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/254,139

(22) Filed: Sep. 1, 2016

(65) Prior Publication Data

US 2017/0078792 A1 Mar. 16, 2017

(30) Foreign Application Priority Data

Sep. 16, 2015 (EP) ..... 15185540

(51) Int. Cl.
*H04R 3/00* (2006.01)
*H04R 29/00* (2006.01)
*B41J 2/045* (2006.01)

(52) U.S. Cl.
CPC ..... *H04R 3/007* (2013.01); *B41J 2/0451* (2013.01); *B41J 2/04508* (2013.01); *B41J 2/04581* (2013.01); *B41J 2/04588* (2013.01); *H04R 29/001* (2013.01)

(58) Field of Classification Search
CPC .. B41J 2/0451; B41J 2/04508; B41J 2/04581; B41J 2/04588; H04R 3/007; H04R 29/001
USPC ..... 347/12, 19, 48; 381/94.2, 97, 98; 379/417
See application file for complete search history.

(56) References Cited

U.S. PATENT DOCUMENTS 4,381,515 A * 4/1983 Bain ..... B41J 2/04525 310/317
6,285,766 B1 * 9/2001 Kumamoto ..... H04S 1/007 381/123
6,449,368 B1 * 9/2002 Davis ..... H04S 1/002 381/1
6,647,067 B1 * 11/2003 Hjelm ..... H04B 3/487 370/201

(Continued)

FOREIGN PATENT DOCUMENTS

EP 0 063 921 A1 11/1982
EP 0 496 525 A1 7/1992

(Continued)

*Primary Examiner* — David Ton
(74) *Attorney, Agent, or Firm* — Birch, Stewart, Kolasch & Birch, LLP

(57) ABSTRACT

A method of removing an electric crosstalk contribution is disclosed. This crosstalk exists in a monitoring signal from a monitored electro-mechanical transducer in a device comprising a plurality of electro-mechanical transducers which are driven by actuation signals so as to produce acoustic waves in an acoustic frequency range. The method comprises the steps of: (a) applying an actuation signal to at least one of the transducers other than the monitored transducer; (b) detecting the monitoring signal in a high frequency range outside of the acoustic frequency range; (c) deriving, from the detected monitoring signal, a number of parameters that characterize the electric crosstalk; and (d) using said parameters to calculate the electric crosstalk contribution in the acoustic frequency range.

6 Claims, 4 Drawing Sheets

(56) References Cited

U.S. PATENT DOCUMENTS

| | | | | |
|---|---|---|---|---|
| 6,719,390 | B1 * | 4/2004 | Howkins | B41J 2/04525 347/12 |
| 8,894,176 | B2 * | 11/2014 | Omo | B41J 2/04525 347/17 |
| 2005/0220312 | A1 * | 10/2005 | Kasai | H04S 1/002 381/97 |
| 2014/0267505 | A1 | 9/2014 | Nakao | |

FOREIGN PATENT DOCUMENTS

| | | | |
|---|---|---|---|
| EP | 1 584 474 | A1 | 10/2005 |
| EP | 2 328 756 | B1 | 5/2014 |
| WO | WO 2010/023135 | A1 | 3/2010 |

* cited by examiner

METHOD FOR REMOVING ELECTRIC CROSSTALK

BACKGROUND OF THE INVENTION

1. Field of the Invention

The invention relates to a method for removing an electric crosstalk contribution in a monitoring signal from a monitored electro-mechanical transducer in a device comprising a plurality of electro-mechanical transducers which are driven by actuation signals so as to produce acoustic waves in an acoustic frequency range. More particularly, the invention relates to a method for determining and cancelling electric crosstalk in monitoring signals from transducers of a jetting device such as an ink jet print head, wherein electric signals produced by the transducers are used for monitoring a condition of the jetting device. The invention also relates to a jetting device, more particularly an ink jet print head in which the method is implemented.

2. Description of the Related Art

EP 1 584 474 A1 and EP 2 328 756 B1 describe embodiments of a piezoelectric ink jet print head having a plurality of jetting units for jetting out liquid ink onto a recording medium in order to form a printed image. Each jetting unit has a nozzle connected to a pressure chamber that is filled with liquid ink. The nozzles and, consequently, the jetting devices are arranged at narrow spacings in order to achieve a high spatial resolution of the print head. Each pressure chamber is associated with a piezoelectric transducer, which, when energized by a voltage pulse, deforms in a manner that causes a change in the volume of the pressure chamber. Consequently, an acoustic pressure wave is generated in the liquid ink in the pressure chamber, and this wave propagates to the nozzle, so that an ink droplet is ejected from the nozzle.

Conversely, when a pressure wave is propagating in the liquid in the pressure chamber, this wave will cause a deformation of the transducer, and the transducer will produce an electric signal (voltage and current signal) in response to the deformation. Consequently, as has been taught in the documents cited above, it is possible to detect the acoustic pressure waves in the pressure chambers by monitoring the signals obtained from the transducers.

When a transducer has been actuated, the pressure wave produced by this transducer will gradually decay in the pressure chamber in the course of time. If, for example, an air bubble has been trapped in the pressure chamber or in the nozzle, this will change, in a characteristic way, the pattern in which the pressure wave decays, so that the presence of the air bubble can be detected by monitoring the decay of the pressure wave.

Similarly, the monitoring signals obtained from the transducers may be used for detecting other conditions of the jetting units, e.g. a condition in which a nozzle is partly or completely clogged by contaminants. Examples of other conditions and/or ink properties that may be monitored in this way are the viscosity of the ink and the position of the air/liquid meniscus in the nozzle, which position changes the resonance frequency of the acoustic wave in the pressure chamber.

Since the plurality of transducers of the jetting device form part of a common actuating and monitoring circuitry, and electrical leads of this circuitry are relative closely packed in the device, due to the close packing of the jetting units of the print head, there will inevitably be a certain amount of electric crosstalk between the actuators. Consequently, when one actuator is monitored while the jetting device is operating, the monitoring signal will reflect not only the pressure wave in the jetting unit that is being monitored, but will also include a certain amount of crosstalk from other transducers that have been actuated simultaneously. This may compromise the accuracy in the detection of the condition of the jetting unit.

It is therefore an object of the invention to determine the crosstalk contribution in the monitoring signal, so that this contribution may be eliminated when the monitoring signal is processed and interpreted.

SUMMARY OF THE INVENTION

In order to achieve this object, the method according to the invention comprises the steps of:

(a) applying an actuation signal to at least one of the transducers other than the monitored transducer;

(b) detecting the monitoring signal in a high frequency range outside of the acoustic frequency range;

(c) deriving, from the detected monitoring signal, a number of parameters that characterize the electric crosstalk;

(d) using said parameters to calculate the electric crosstalk contribution in the acoustic frequency range, and (e) removing the electric crosstalk contribution from the monitoring signal.

The invention takes advantage of the fact that the waveform of the electric crosstalk is linked to the actuation signal which is the source of the crosstalk by a known transfer function. This transfer function can be derived from theoretical considerations for different types of electric crosstalk, such as capacitive crosstalk, resistive crosstalk and inductive crosstalk. Thus, what remains to be determined in order to calculate the total crosstalk contribution is a set of frequency independent parameters which indicate the strengths or amplitudes with which the different types of crosstalk contribute to the monitoring signal. In the acoustic frequency range, the monitoring signal will also contain a contribution from the acoustic signal that is be monitored. Thus, in the acoustic frequency range, it is difficult to distinguish between the different contributions to the monitoring signal. However, in a high frequency range the acoustic waves are attenuated practically completely, so that, in this high frequency range, the monitoring signal consists only of the contributions of the various types of crosstalk. Thus, by analysing the monitoring signal in a high frequency range, it is possible to identify the parameters that will then also determine the contribution of the crosstalk in the acoustic frequency range.

More specific optional features of the invention are indicated in the dependent claims.

In a typical design of a jetting device, the crosstalk has a dominant capacitive component that is proportional to the time derivative of the actuation signal, and a less pronounced resistive component that is proportional to the second derivative of the actuation signal. In principle, there is also an inductive component which is also proportional to the second derivative but can be neglected in most cases.

Then, the electric crosstalk contribution will be a linear combination of a capacitive component and a resistive component and the coefficients of these components in the linear combination will form the parameters to be determined.

In an embodiment, a Fourier transformation, e.g. a Fast Fourier Transformation (FFT) is applied to the monitoring signal so as to obtain a spectrum of the monitoring signal over a frequency range including at least a substantial part of the high frequency range. Similarly, a spectrum of the first derivative of the actuation signal can be obtained by applying a FFT to the first derivative. A spectrum of the second derivative can be calculated, either by differentiating the first derivative and then applying an FFT, or by calculating the spectrum of the second derivative directly from the spectrum of the first derivative, using the differentiation theorem for the Fourier transformation:

$$F(h')(f)=i*f*F(h)(f) \quad (1)$$

wherein h is a (time dependent) function, h' is its derivative, and F is the Fourier transformation operator.

It is possible to use one and the same electrical circuit for measuring the monitoring signal from the transducer and for measuring the first derivative of the actuation signal. This has the advantage that the effect of the measuring circuit on the measured monitoring signal will be the same as the effect of the measuring circuit on the first derivative, so that these effects cancel out when the measurement results are compared.

The method according to the invention may be carried out while the device, e.g., the print head, is operating, so that the properties of the jetting devices can be monitored quasi continuously during the operation of the device.

The method may further be combined with other measures for suppressing acoustic and electric crosstalk. For example, instead of deriving the monitoring signal directly from the monitored transducer, it is possible to form a difference between the signal obtained from the monitored transducer and a signal obtained from a reference capacitor or reference transducer that is not sensitive to the acoustic signal. Then, the difference between the two signals will mainly reflect the effect of the acoustic pressure wave whereas electric crosstalk and acoustic crosstalk via the solid material of the device are largely suppressed. The method according to the invention may then be applied in order to obtain an even higher accuracy.

BRIEF DESCRIPTION OF THE DRAWINGS

An embodiment example will now be described in conjunction with the drawings, wherein.

DETAILED DESCRIPTION OF EMBODIMENTS

Figure 1:
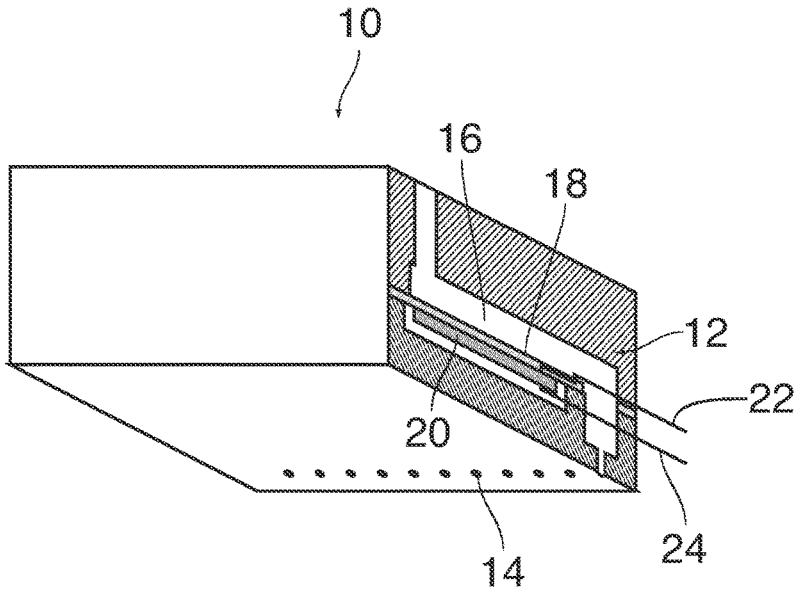
FIG. 1 is a perspective view, partly in section, of an ink jet print head as an example of a device to which the invention is applicable.

As is shown in FIG. 1, a jetting device 10, more particularly, a piezoelectric ink jet print head, has a plurality of jetting units 12 one of which has been shown in section in FIG. 1. Each jetting unit 12 has a nozzle 14, and the jetting units 12 are juxtaposed in the device such that the nozzles 14 form a row with narrow nozzle-to-nozzle spacings.

In each jetting unit 12, the nozzle 14 communicates with a pressure chamber 16 that is connected to an ink supply system and filled with liquid ink. One wall of the pressure chamber 16 is formed by a flexible membrane 18, and a piezoelectric transducer 20 is attached to the membrane 18 on a side opposite to the side facing the pressure chamber 16. The transducer 20 has electrodes that are connected to electrical leads 22 and 24 which have been shown only schematically in FIG. 1.

Figure 2:
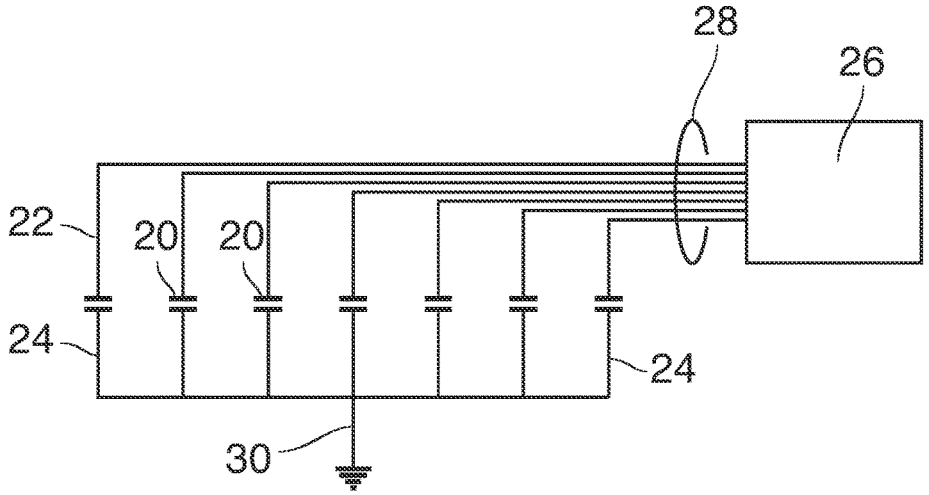
FIG. 2 is an electric circuit diagram of the device shown in FIG. 1.

FIG. 2 is a simplified circuit diagram of the device 10, wherein each transducer 20 has been represented by a capacitor. The leads 22 of each transducer are connected to an electronic control circuit 26 via a multi-lead flex line 28, whereas the leads 24 of each transducer are connected to a common ground line 30.

The control circuit 26 is arranged to actuate the transducers 20 individually and independently from one another by applying voltage pulses to the leads 22 in accordance with image information to be printed. The voltage pulses cause the transducer 20 to deform in a bending mode, so that the membrane 18 (FIG. 1) is flexed inwardly and outwardly into and from the pressure chamber 16. As a result, an acoustic pressure wave is generated in the liquid in the pressure chamber 16 and propagates to the nozzle 14, where a droplet of ink is expelled.

Conversely, when a pressure wave is present in the pressure chamber 16, e.g. a pressure wave resonating in the pressure chamber and gradually decaying after a droplet has been expelled, the pressure fluctuations will cause a deformation of the transducer 20 which will translate this deformation into an electric signal (voltage and current) that is transmitted to the control circuit 26 via the lead 22. Thus, it is possible to monitor the condition of each jetting unit 12 by detecting monitoring signals that are formed by electric currents flowing into and out of each transducer via the leads 22.

Figure 3:
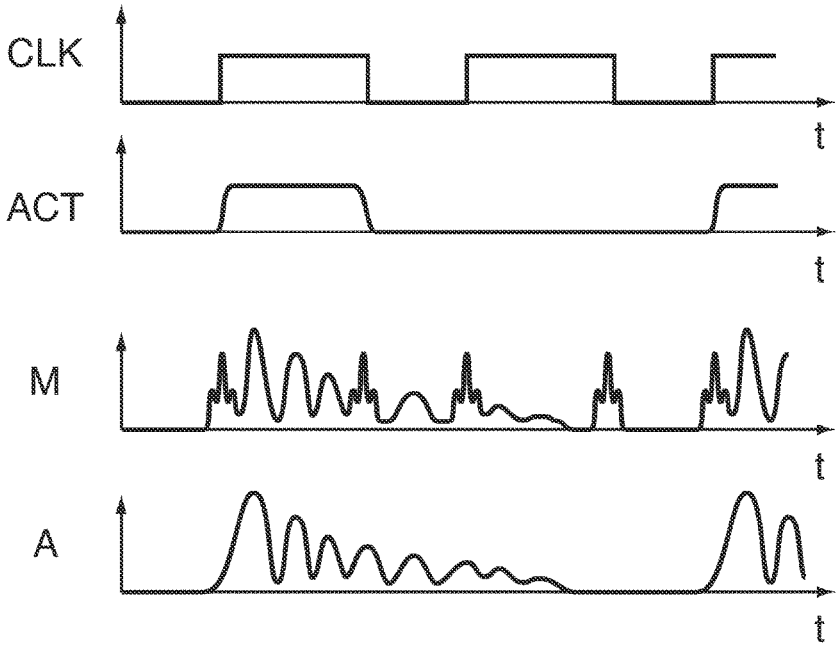
FIG. 3 shows waveforms of various signals in an electronic control circuit of the device shown in FIGS. 1 and 2.

When the device 10 is operating, the voltage pulses are applied to the transducers 20 in synchronism with a common clock signal CLK the waveform of which has been shown in FIG. 3 as a function of time t.

FIG. 3 further shows an example of an actuating signal ACT that is applied to one of the transducers 20 under the control of the control circuit 26. When an image pixel is to be printed and, accordingly, an ink droplet is to be ejected from the pertinent jetting device, the actuating signal ACT has the shape of a pulse similar to a corresponding pulse of the clock signal CLK. In a period of the clock signal where no droplet is to be expelled from the jetting unit, the pulse in the actuating signal ACT is omitted.

Another curve in FIG. 3, although on a very different scale, shows a monitoring signal M which is received in the control circuit 26 via the lead 22 of the transducer that has been energized by the actuating signal ACT. This monitoring signal M reflects not only the mechanical deformations of the piezoelectric transducer 20 but includes also an electric crosstalk contribution from actuating signals from other transducers of the device that have been actuated at the same time. A main source of the crosstalk is a capacitive coupling between the leads 22 which are closely juxtaposed in the flex line 28. Another source is a resistive crosstalk resulting from the fact that the various transducers 20 share certain leads such as the ground lead 30, and these shared leads have a certain electrical resistance.

Figure 4:
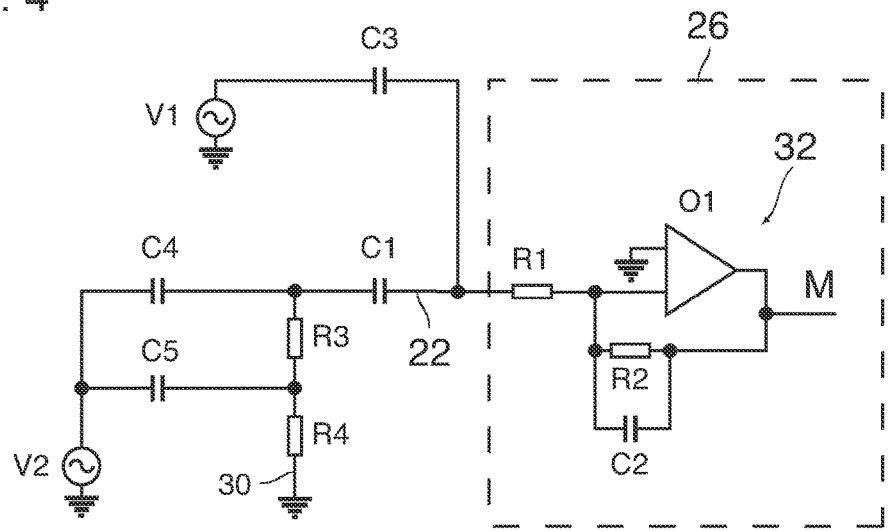
FIG. 4 is a circuit diagram modelling the effect of electric crosstalk in the circuit shown in FIG. 2.

FIG. 4 is a circuit diagram modelling these two sources of crosstalk. A capacitor C1 in FIG. 4 represents one of the transducers 20 that is presently been monitored and is therefore also designated as the "monitored transducer C1". Within the control circuit 26 the lead 22 of the monitored transducer is connected to a measuring circuit 32 that provides the monitoring signal M. As is known in the art, the measuring circuit 32 is constituted by a resistor R1 and an operational amplifier O1 having a resistor R2 and a capacitor C2 connected in parallel in the feedback loop.

A capacitor C3 represents the capacitive crosstalk, and a voltage source V1 represents the source of this capacitive crosstalk, i.e. the actuation signals applied to other transducers, especially to one or more transducers in the neighbourhood of the monitored transducer C1 (in this context "neighbourhood" means that there is some capacitive coupling between the leads 22 associated with these transducers).

The resistive crosstalk is modelled by two capacitors C4, C5 and two resistors R3 and R4. The capacitors C4 and C5 represent two transducers 20 other than the monitored transducer C1. The resistors R3 and R4 represent the electrical resistance of the leads connecting the transducers 20 to the ground line 30 and the electrical resistance of the ground line 30 itself, respectively. The source of the resistive crosstalk is represented by a voltage source V2 applying an actuation signal to the capacitors (transducers) C4 and C5.

Although a voltage source applying the actuation signal ACT to the monitored transducer C1 has not been shown in FIG. 4, it is possible to obtain the monitoring signal M even in time periods in which the monitored transducer C1 is actuated.

In the model shown in FIG. 4, the capacitive crosstalk (the current flowing into and out of the capacitor C3) is proportional to the first time-derivative of the actuation signal provided by the voltage source V1. The resistive crosstalk (current flowing into and out of C1 due to a voltage drop at R3 and R4) is proportional to the second derivative of the actuation signal provided by the voltage source V2.

The waveform of the monitoring signal M shown in FIG. 3 is a superposition of the first derivative D of the actuating signal ACT (the signal provided by V1), the second derivative DD of the actuating signal ACT (the signal provided by V2) and an acoustic signal A that reflects the mechanical deformation of the monitored transducer C1. The waveform of this acoustic signal A has been shown separately in FIG. 3. The problem to be solved is to reconstruct the acoustic signal A from the monitoring signal M as provided by the measuring circuit 32.

When D is the first derivative of the actuation signal ACT, and DD is the second derivative of the actuation signal, the fact that the monitoring signal M is a superposition of the capacitive crosstalk, resistive crosstalk and the acoustic signal A, can be expressed by the following formula:

$$M=A+Ad*D+Add*DD \quad (2)$$

wherein Ad and Add are constant coefficients that have to be determined.

Figure 5:
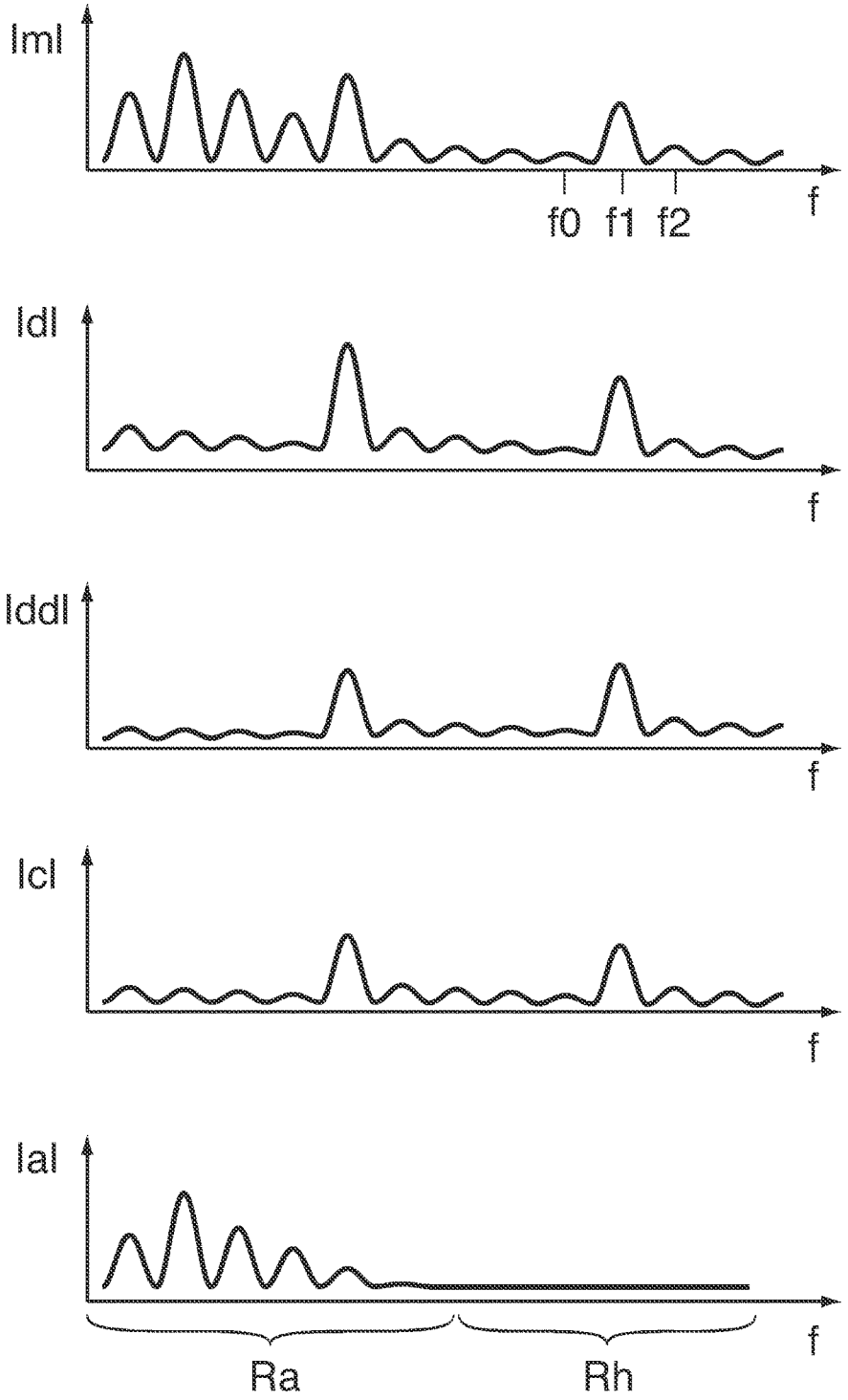
FIG. 5 shows spectra of various signals to be considered in the method according to the invention.

In order to determine these coefficients, the monitoring signal M is subjected to an FFT, resulting in a spectrum $\underline{m}$ that has been shown in the uppermost graph in FIG. 5. More precisely, the full spectrum of M is a complex function $\underline{m}(f)$ of the frequency f, and FIG. 5 shows only the absolute value |m| of that function.

Further, the first derivative D of the actuation signal ACT is calculated or is measured with a suitable measuring circuit. In a preferred embodiment, this is done by disconnecting the resistor R1 in FIG. 4 from the capacitor C1 and connecting it only to the capacitor C3, so that the derivative D is measured with the same measuring circuit 32 as the monitoring signal M. Of course, this implies that the monitoring signal M and the derivative D are measured in different cycles of the clock signal CLK. After determining the derivative D, it is saved for further use, and as long as the actuation signal ACT does not change, the derivative signal D will not change either. It is therefore not necessary to determine D for every measurement of the monitoring signal M.

The measured derivative D is then also subjected to an FFT, resulting in a spectrum d the absolute value |d| of which shown in the second graph in FIG. 5.

A spectrum $\underline{dd}$ of the second derivative DD can be calculated directly from the spectrum $\underline{d}$ or can be obtained by calculating the second derivative DD (as a function of time) and then subjecting the result to an FFT. The resulting absolute value |dd| is shown in the third graph in FIG. 5 (the peaks at higher frequencies are higher because of equation (1)).

The fourth graph in FIG. 5 shows a spectrum c of the complete electric crosstalk contribution, i.e. the superposition of the spectra $\underline{d}$ and $\underline{dd}$ with the (so far still unknown) coefficients Ad and Add. Would the spectrum $\underline{c}$ be known, then it would be possible to obtain a spectrum $\underline{a}$ of the acoustic signal A by subtracting the spectrum $\underline{c}$ from the spectrum $\underline{m}$. Then, if desired, the acoustic signal A could be reconstructed by applying an inverse Fourier transformation to the spectrum $\underline{a}$.

As can be seen in the lowermost graph in FIG. 5, the acoustic signal A and its spectrum $\underline{a}$ "live" only in an acoustic frequency range Ra, and there is no acoustic signal in a high frequency range Rh. The reason is that above a certain frequency of, e.g. 400 kHz (depending upon the viscosity of the ink), the acoustic waves are attenuated so rapidly that no acoustic signal is detectable.

This means that, in the high frequency range Rh, the monitored signal M and its spectrum m consist only of the superposition of capacitive crosstalk ($Ad*\underline{d}$) and resistance crosstalk ($Add*\underline{dd}$). For a given frequency f0 in the high frequency range Rh, e.g. between 400 and 900 kHz, it is therefore possible to calculate the coefficients Ad and Add by comparing the spectra $\underline{m}$, $\underline{d}$ and $\underline{dd}$. For that specific frequency f0, the complex value of the spectrum $\underline{m}$ has the real part rm and the imaginary part im. The complex value of the spectrum $\underline{d}$ has the real part rd and the imaginary part id. The complex value of the spectrum $\underline{dd}$ has the real part rdd and the imaginary part idd.

Thus, for this specific frequency, the formula (2) results in the following two equations:

$$rm=Ad*rd+Add*rdd$$

$$im=Ad*id+Add*idd \quad (3)$$

These two equations constitute a linear system of two equations with two unknowns Ad and Add and can therefore be resolved for Ad and Add. Then, these known coefficients can be used for calculating the spectrum c over the full frequency range, i.e. also in the acoustic frequency range Ra, so that the spectrum $\underline{a}=\underline{m}-\underline{c}$ can now be calculated.

In order to improve the accuracy in the determination of the coefficients Ad and Add, it is possible to repeat the above calculation for different frequencies f1, f2, etc. within the high frequency range Rh and then to average the results.

In a simplified version of this method the resistance crosstalk can be considered as neglectable by assuming Add=0.

Figure 6:
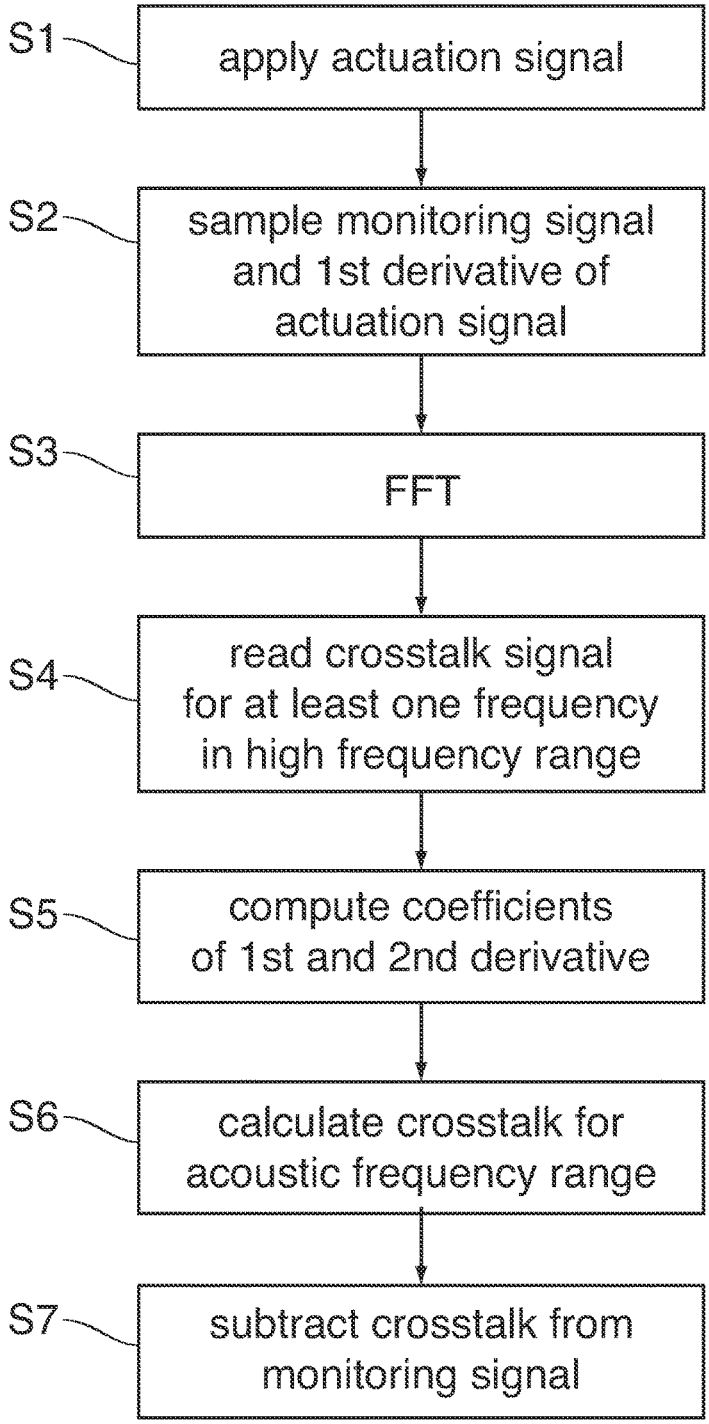
FIG. 6 is a flow diagram illustrating the basic steps of the method according to the invention.

The essential steps of the method described above are summarized in the flow diagram in FIG. 6.

In step S1, the actuation signal ACT is applied to at least one of the transducers 20 and optionally also to the monitored transducer C1. It will be observed, that when the device is operating, this step will be performed anyway in each cycle of the clock signal CLK. Then, of course, there may be cycles where two or more actuators in the neighbourhood of the monitored actuator are energized, which will result in a high crosstalk contribution, and there may be cycles where the actuation signal is applied only to actuators that are remote from the monitored actuator, so that the crosstalk contribution will be smaller. However, these differences will affect only the coefficients Ad and Add which are determined by the method according to the invention, so that the method adapts "automatically" to the instantaneous energizing pattern of the actuators.

In step S2, the monitoring signal M is sampled over a certain time period, e.g. one or more clock cycles. The first derivative of the actuation signal is sampled in the same step.

Then, the fast Fourier transforms FFT are applied in step S3, resulting in the spectra m, d and (by calculation) dd.

In step S4, the complex value of these spectra are read for at least one frequency in the high frequency range Rh, and the coefficients Ad and Add are calculated in step S5.

In step S6, the calculated coefficients Ad and Add are used for calculating the spectrum c also in the acoustic frequency range, and the spectrum a of the acoustic signal is calculated in step S7 by subtracting c from m. Optionally, an inverse Fourier transformation may then be applied to the spectrum a so as to obtain the acoustic signal A (as a time dependent function) from which the electric crosstalk contributions have been removed. This acoustic signal may be interpreted to derive information about the state of the associated transducer.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. A method for removing an electric crosstalk contribution in a monitoring signal from a monitored electro-mechanical transducer in a device comprising a plurality of electro-mechanical transducers which are driven by actuation signals so as to produce acoustic waves in an acoustic frequency range, the method comprising the steps of:

(a) applying an actuation signal to at least one of the transducers other than the monitored transducer;

(b) detecting the monitoring signal in a high frequency range outside of the acoustic frequency range;

(c) deriving, from the detected monitoring signal, a number of parameters that characterize the electric crosstalk;

(d) using said parameters to calculate the electric crosstalk contribution in the acoustic frequency range, and (e) removing the electric crosstalk contribution from the monitoring signal.

2. The method according to claim 1, wherein the electric crosstalk contribution is considered as a superposition of first and second derivatives of the actuation signal, and the parameters derived in step (c) are coefficients of the derivatives in that superposition.

3. The method according to claim 2, wherein a measuring circuit is used for measuring the first derivative of the actuation signal.

4. The method according to claim 3, wherein the measuring circuit is a circuit that is also used for measuring the monitored signal.

5. The method according to claim 1, wherein the steps (a)-(d) are performed while a device is operating.

6. A jetting device comprising a plurality of jetting units each of which has an electromechanical transducer, and an electronic control circuit for driving the transducers and for receiving monitoring signals from the transducers, wherein the control circuit is configured to perform the method according to claim 1.

* * * * *